US005186446A

United States Patent [19]

Saeki et al.

[11] Patent Number: 5,186,446

[45] Date of Patent: Feb. 16, 1993

[54] RECYCLING AUTOMATIC DOCUMENT FEEDER

[75] Inventors: Shiro Saeki, Yokohama; Yukitaka Nakazato, Tokyo; Hiroyuki Ishizaki, Ogaki; Fumitaka Hyodou, Nukata; Kunihiro Uotani, Seto, all of Japan

[73] Assignee: Ricoh Company, Ltd., Tokyo, Japan

[21] Appl. No.: 769,841

[22] Filed: Oct. 2, 1991

[30] Foreign Application Priority Data

Oct. 3, 1990 [JP] Japan ..... 2-267293

[51] Int. Cl.[5] ..... B65H 5/22

[52] U.S. Cl. ..... 271/3.1; 355/317; 355/321

[58] Field of Search ..... 271/3.1, 35, 110, 111, 271/256, 258, 259, 265; 355/309, 317, 321

[56] References Cited

U.S. PATENT DOCUMENTS

| | | | |
|---|---|---|---|
| 4,610,533 | 9/1986 | Takahata | 355/309 |
| 4,850,581 | 7/1989 | Hayakawa et al. | 271/10 |
| 4,957,285 | 9/1990 | Yamada | 271/3.1 |
| 5,018,714 | 5/1991 | Henjo et al. | 271/3.1 |
| 5,076,559 | 12/1991 | Lawniczak | 271/3.1 |

*Primary Examiner*—A. T. Grimley
*Assistant Examiner*—P. J. Stanzione
*Attorney, Agent, or Firm*—Oblon, Spivak, McClelland, Maier & Neustadt

[57] ABSTRACT

A recycling automatic document feeder (RADF) for use with a copier or similar equipment for feeding a stack of documents to an illuminating position one by one, then returning each document, and repeating the cycle to illuminate the documents a plurality of times. A gate pawl is located movable into and out of contact with a document table. A feeding section has feeding means for feeding, a stack of documents on the table one by one. A transporting section transports the document fed from the feeding section to a predetermined illuminating position and, then, discharges the document. A returning section turns over the document transported by transporting means. The returning section returns the document discharged to the top of the stack of documents. Sensors sense a condition in which the documents are fed or transported. A controller performs control in response to output signals of the sensors such that when the stack of documents is to be illuminated a plurality of times, the gate pawl is moved away from the table after the illumination of the last document of the first cycle to start the feed of the second cycle, then the gate pawl is brought into contact with the top of the stack, and then the gate pawl is moved away from the top of the stack to transport the remaining documents to a feed position one by one, dividing the first and second cycles of documents.

6 Claims, 15 Drawing Sheets

RECYCLING AUTOMATIC DOCUMENT FEEDER

BACKGROUND OF THE INVENTION

1. Field of the Invention:

The present invention relates to a recycling automatic document feeder (RADF) usable with a copier or similar equipment for sequentially feeding a stack of documents to a predetermined illuminating position one by one, returning each document undergone illumination to the top of the stack, and repeating such a cycle to illuminate each document a plurality of times.

2. Discussion of Background

A RADF of the type described is useful when a copier is operated to produce plurality of copies with each of a plurality of documents stacked on a table of the copier. Specifically, a RADF automatically feeds a stack of documents from a table thereof one by one, the lowermost document being first, to a glass platen incorporated in the copier by way of a path which forms part of a recycling path. The documents undergone illumination are each returned to the top of the stack remaining on the table by way of another part of the recycling path. Such a procedure is repeated a particular number of times corresponding to the desired number of copies. A conventional RADF has, in addition to the table, a gate pawl, a feeding section, a transporting section, a returning section, sensing means, and control means. The gate pawl is located forwardly of the table with respect to an intended direction of document feed and movable into and out of contact with the table. The feeding section has feeding means for feeding the documents from the table one by one, the lowermost document being first, when the gate pawl is moved away from the table. The transporting section has transporting means for transporting each document fed from the feeding section to a predetermined illuminating position on the glass platen and, after illumination, discharges the document. The returning section has turning means for turning over the document from the transporting section and returns the document having been turned over to the top of the stack remaining on the table. The sensing means is responsive to a condition in which the documents are fed and transported. The control means controls the gate pawl and above-mentioned means in response to the outputs of the sensing means. The gate pawl rests on the top of the stack on the table to divide the stack from documents which are sequentially returned thereto from the returning section.

When a plurality of documents stacked on the table should be repetitively illuminated to produce a plurality of copies with each document, it has been customary that after the last document of the first cycle of documents has been fully discharged onto the top of the stack on the table, the first document of the second cycle of documents is fed to the illuminating position. More specifically, it is only after all the first cycle of documents have been fully discharged that the second cycle of documents start to be fed. The conventional RADF, therefore, consumes a substantial period of time in replacing the first and second cycles of documents. This is especially true with a RADF of the type having a returning section which extends over a long distance, undesirably increasing the illuminating time, i.e., copying time.

SUMMARY OF THE INVENTION

It is, therefore, an object of the present invention to provide a RADF for a copier which reduces the waiting time between the end of copying of the first cycle of documents and the start of copying of the second cycle of documents and, therefore, the overall copying time for copying a pluality of documents.

It is another object of the present invention to provide a generally improved RADF for a copier.

A recycling automatic document feeder (RADF) for use with a copier or similar equipment for sequentially feeding a stack of documents to a predetermined illuminating position one by one, returning each document undergone illumination to the top of the stack, and repeating such a cycle to illuminate the documents a plurality of times. The RADF has a table to be loaded with a stack of documents. A gate pawl is located forwardly of the table with respect to an intended direction of document feed and movable into and out of contact with the table. A feeding section has feeding means for feeding, when the gate pawl is moved away from the table, a stack of documents placed on the table one by one, the lowermost document being first. A transporting section has transporting means for transporting the document fed from the feeding section to a predetermined illuminating position and, after illumination, discharging the document. A returning section has turning means for turning over the document transported by the transporting means. The returning section returns the document discharged via the turning means to the top of the stack of documents. Sensors are each senses a condition in which the documents are fed or transported. A controller performs control in response to the output signals of the sensors such that when the stack of documents is to be illuminated a plurality of times, the gate pawl is moved away from the table after the illumination of the last document of the first cycle of documents to start the feed of the second cycle of documents, then the gate pawl is brought into contact with the top of the stack, and then the gate pawl is moved away from the top of the stack to transport the remaining documents to a feed position one by one, whereby the gate pawl divides the first and second cycles of documents from each other.

BRIEF DESCRIPTION OF THE DRAWINGS

The above an other objects, features and advantages of the present invention will become more apparent from the following detailed description taken with the accompanying drawings in which.

DESCRIPTION OF THE PREFERRED EMBODIMENTS

Figure 1:
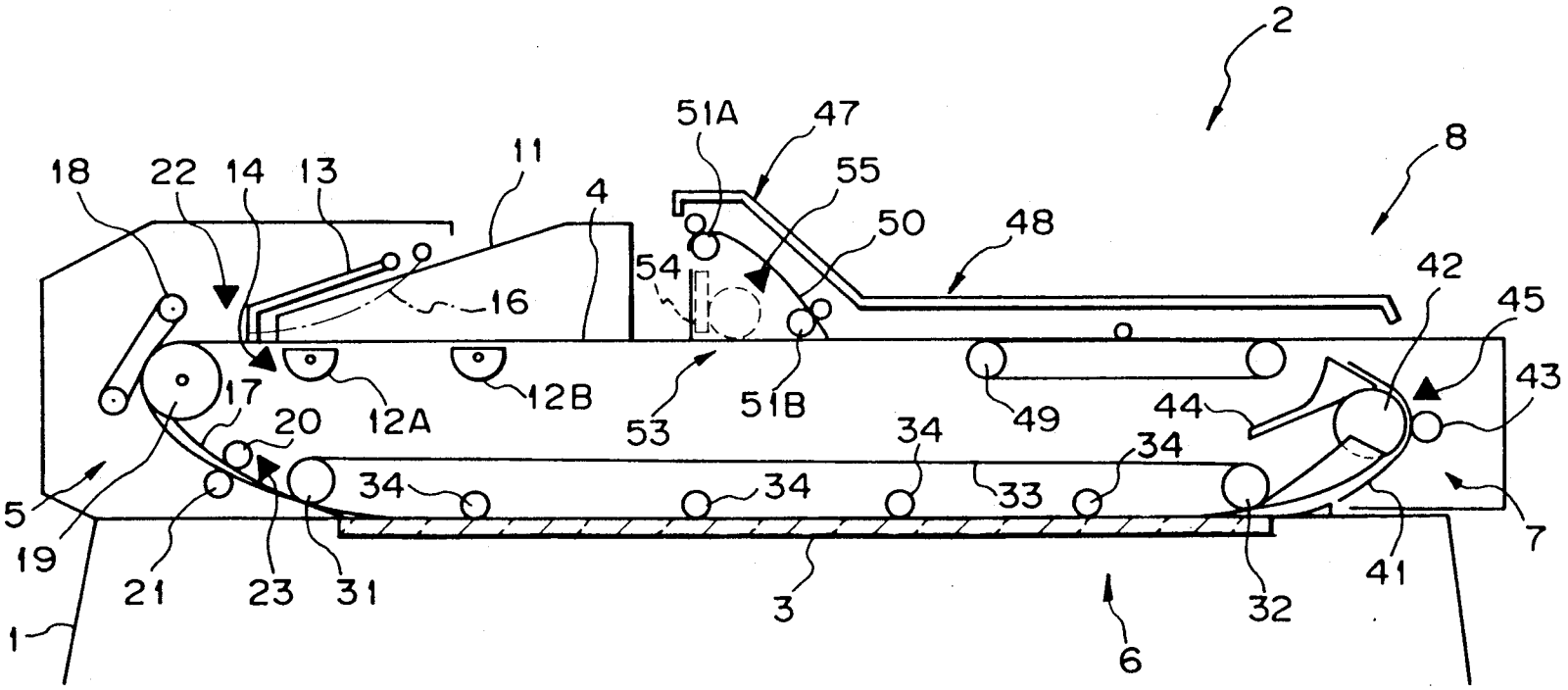
FIG. 1 is a section showing a RADF embodying the present invention.
Figure 2A:
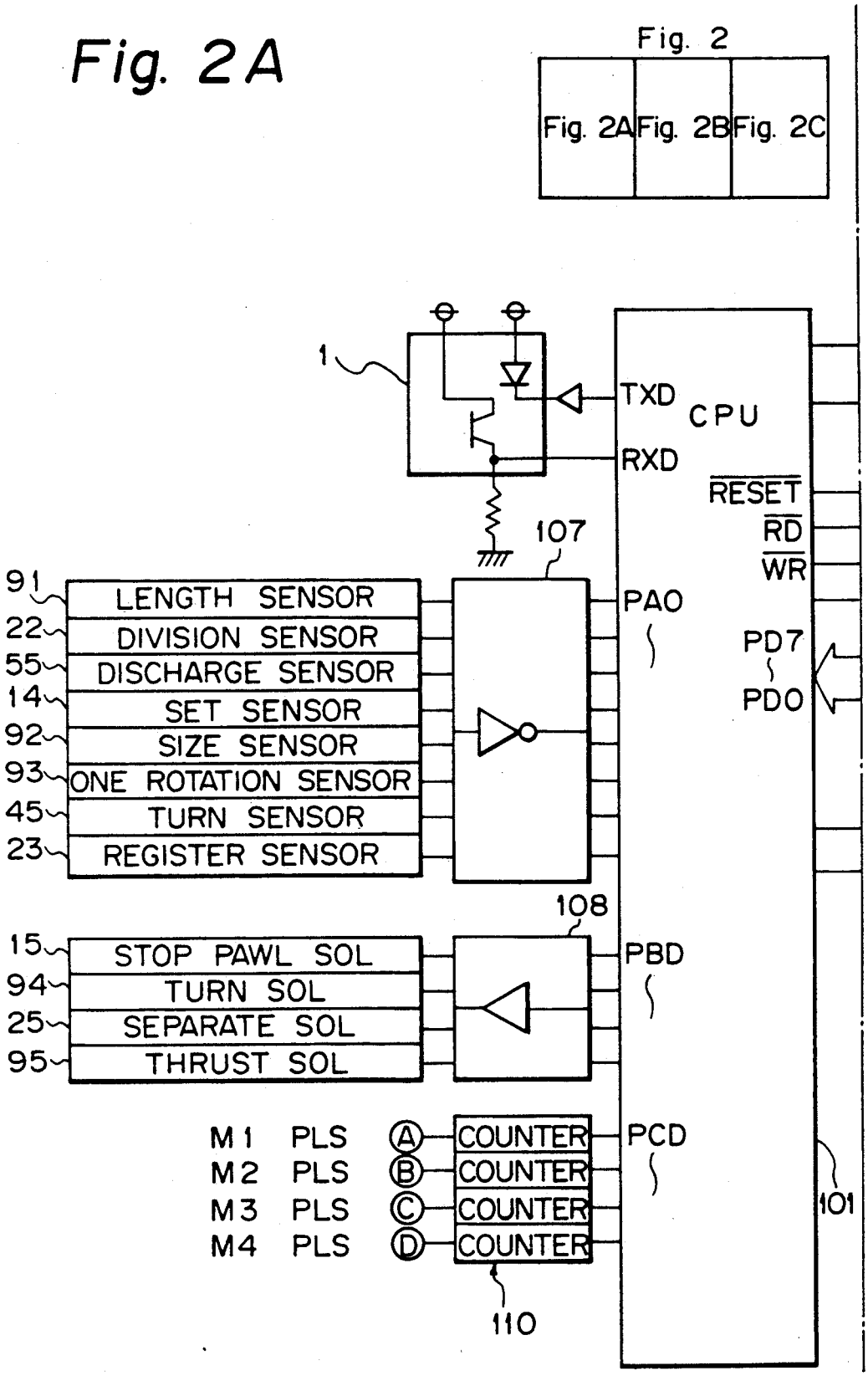
FIGS. 2A–2C are a block diagram schematically showing control means associated with the embodiment.
Figure 2B:
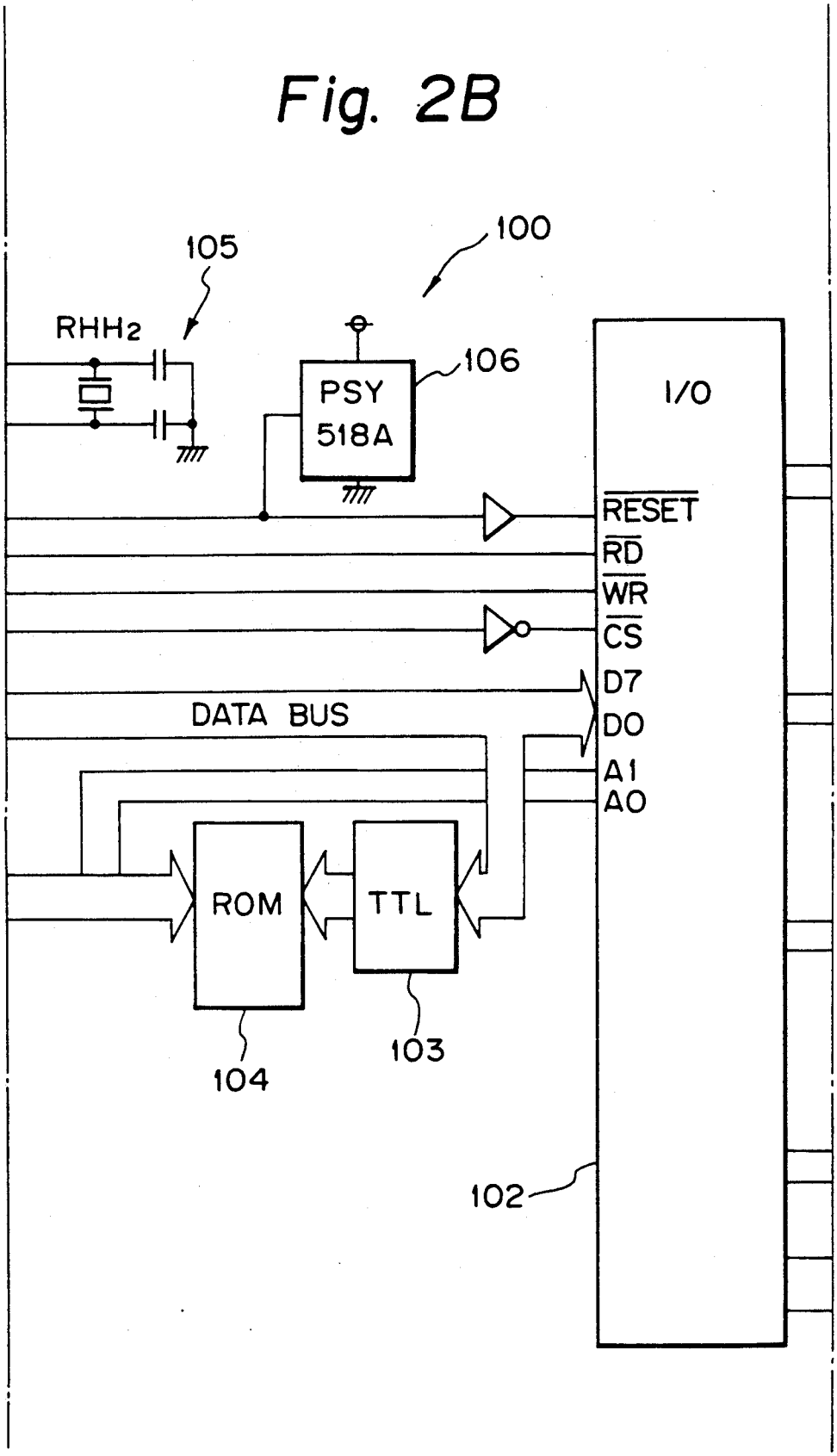
Figure 2C:
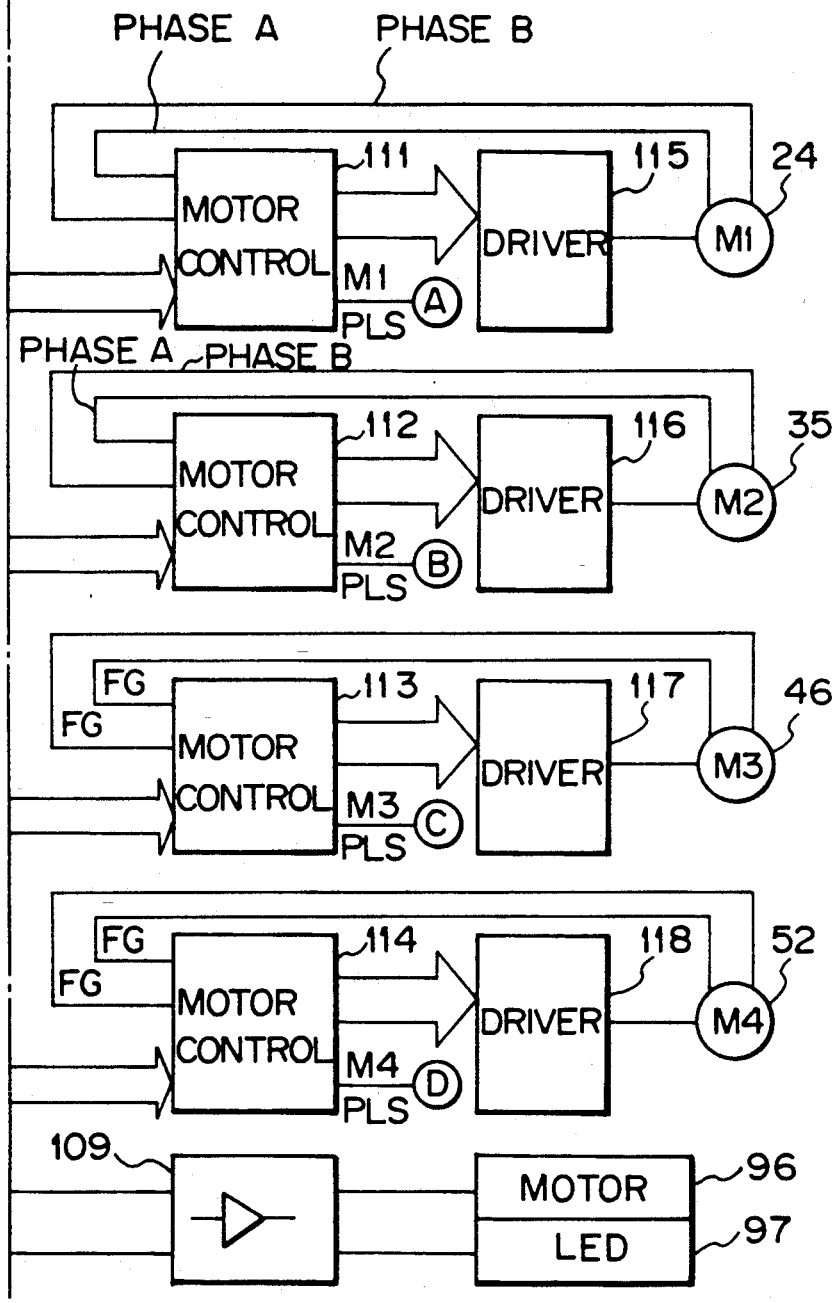

Referring to FIGS. 1 and 2, a RADF embodying the present invention is shown and generally designated by the reference numeral 2. The RADF 2 is mounted on a copier body 1 in such a manner as to cover a glass platen 3. The RADF 2 has a table 4 to be loaded with a stack of documents. A feeding section 5 feeds a stack of documents from the table 4 one by one toward the glass platen 3, the lowermost document being first. A transporting section 6 has transporting means for transporting the document fed from the feeding section 5 to a predetermined illuminating position on the glass platen 3 and, after illumination, discharging it, as will be described specifically later. A returning section 8 has turning means for turning over the document driven thereto from the transporting section 6 and returns the document having been turned over by the turning means 7 to the table 4. Various sensors, which will be described, are each responsive to a condition in which the document is fed or transported. Control means, which will also be described, controls such sections of the RADF 2 in response to the outputs of the sensors.

The table 4 is located at one end or front end of the RADF 2 with respect to the intended direction of document transport. Arranged on the table 4 are a pair of side fences 11, partly removed pick-up rollers 12A and 12B, and a gate pawl 13 movable into and out of contact with the table 4. The gate pawl 13 rests on the top of the document stack put on the table 4 by gravity. As documents are sequentially routed through a recycling path which will be described, they reach the gate pawl 13 from behind the latter. Then, such documents abut against the end of the gate pawl 13 to be thereby divided from the documents remaining on the table 4. At the same time, the gate pawl 13 serves to correct the skew of the documents having been so returned to the table 4. A document set sensor 14 is located in front of the pick-up rollers 12A and 12B to determine whether or not documents exist on the table 4. The gate pawl 13 is supported by the side walls, not shown, of the RADF 2 and rotatable up and down, i.e., toward and away from the table 4. When a controller or control means which will be described operates a solenoid 15, FIG. 2, in response to a start signal sent from the copier body 1, the solenoid 15 raises the gate pawl 13 to allow the first cycle of documents stacked on the table 4 to be fed or allows the returned documents (second and successive cycles of documents) to be refed. A presser plate 16 is implemented as a flexible sheet such as a Mylar sheet and precedes the gate pawl 13 with respect to the transport direction. The presser plate 16 is also moved up and down by the solenoid 15 and, when moved downward, presses the top of the document stack by a predetermined pressure while deforming itself.

In the feeding section 5, a curved transport guide 17 extends from a position adjacent to the gate pawl 13 to one end of the glass platen 3. An endless belt 18 is arranged along the transport guide 17. A separator roller 19 has a one-way clutch, not shown, built therein and is pressed against the endless belt 18. Pull-out rollers 20 and 21 cooperate to pull out a document separated by the belt 18 and separator roller 19 toward the glass platen 3. A division sensor 22 is positioned in front of the gate pawl 13. When the gate pawl 13 is held in contact with the top of a document stack on the table 4 while dividing it from documents sequentially returned to the table 4, the division senor 22 detects such a condition by sensing the documents. A register sensor 23 is responsive to the leading and trailing edges of a document being transported. The reference numeral 24 designates a feed motor, FIG. 2. The belt 18 and separator roller 19 separate the lowermost document from the others due to a difference between their moving speeds and a difference between their coefficients of friction and the coefficient of friction of documents. A clutch 25, FIG. 2, is provided for selectively interrupting the drive of the separator roller 19. When the register sensor 23 senses the leading edge of a document, the clutch 25 is uncoupled to interrupt the drive transmission to the separator roller 19.

The transporting section 6 has an endless belt 33 which is passed over a pair of rollers 31 and 32 to play the role of transporting means. A plurality of press rollers 34 urge the lower run of the belt 33 against the glass platen 3. Driven by a transport motor 35, FIG. 2, the belt 33 conveys a document fed from the feeding section 5 to a predetermined illuminating position on the glass platen 3 and, after illumination, conveys it to the returning section 8. The above-mentioned illumination position is, for example, a position where the trailing edge of a document substantially coincides with the left end of the glass platen 3, as viewed in FIG. 1. After the register sensor 23 has sensed the trailing edge of a document, the belt 33 is reversed in response to the output of an encoder which is representative of the number of rotations of the pull-out roller 20.

The returning section 8 has a turn guide 41 extending upward from the other end of the glass platen 3 in a curved configuration. A turn roller 42 is located such that the periphery thereof extends along the turn guide 41. A press roller 43 is pressed against the turn roller 42. A selector in the form of a pawl 44 is located downstream of the turn roller 42 and movable between a first and a second illuminating position which will not be described specifically. A turn sensor 45 is responsive to a document existing on a turn path which is defined by and inside of the turn guide 41. A turn motor 46, FIG. 2, drives the turn roller 42. The turn guide 41, turn roller 42, press roller 43 and turn motor 46 constitute the turning means 7 in combination. When a document is moved along the turn path inside of the turn guide 41, the turn guide 41 turns it over, i.e., upside down. The turn roller 42 and press roller 43 are driven by a motor independent of the motor for driving the belt 33 and are rotated in interlocked relation to the movement of the belt 33 in response to the output of the turn sensor 45. When the selector 44 is located in the previously mentioned first illuminating position, it guides a document undergone illumination, e.g., a one-sided document or a two-sided document whose both sides have been illuminated toward the table 4. In the second illuminating position, the selector 44 turns over an document having been illuminating, e.g., a two-sided document whose one side has been illuminated to return it to the glass platen 3.

The returning section 8 further includes a discharge unit 47 movable on the table 4 in the document transport direction. A contractible guide 48 is connected to the rear end of the discharge unit 47 with respect to the discharge direction of the latter and expands or contracts due to the movement of the unit 47. An intermediate belt 49 conveys a document coming out of the turning means 7 to the discharge unit 47. The discharge unit 47 has a guide 50 defining a transport path extending from the intermediate belt 49 to the document stacking side of the table 4, a plurality of discharge roller pairs 51A and 51B arranged along guide 50, and a discharge motor 52, FIG. 2, for driving the discharge rollers 51A and 51B. The discharge unit 47, guide 48, belt 49, guide 50, rollers 51A and 51B and motor 52 constitute a returning subsection 53 in combination. When documents are stacked in a position where they abut against the gate pawl 13, the returning subsection 53 is moved to and positioned at the trailing edge of the stack of documents by moving means, not shown. A thrust plate 54 is also included in the returning subsection 53. When a stack of documents is put on the table 4 or when a stack of documents is to be refed (second and successive cycles) from the table 4, the thrust plate 54 pushes the stack toward the separator roller 19 in response to a control signal from a controller 100, FIG. 2. A discharge sensor 55 is located in close proximity to the outlet of the returning subsection 54. On sensing a document coming out of the subsection 53, the discharge sensor 55 delivers discharge information to the controller 100 to which the outputs of the other sensors 14, 22, 23 and 45 are also applied.

As shown in FIG. 2, the controller 100 has a CPU 101, an I/O interface 102, a TTL 103, a ROM 104, a clock circuit 105, a reset IC 106, input and output buffers 107, 108 and 109, counters 110, motor control ICs 111–114, drivers 115–118, and so forth (which are conventional and will not be described specifically). Based on a RADF program stored in the ROM 104 beforehand, the controller 100 controls the motors 24, 35, 46 and 52, solenoid 15 associated with the gate pawl 13, solenoid 94 associated with the selector 44, and a thrust solenoid 95 associated with the thrust plate 54 in response to commands from the copier body 1 and the outputs of the sensors 14, 22, 23, 45, 91, 92 and 93. In FIG. 2, the reference numerals 96 and 97 designate respectively a motor for driving the separator roller 19 and a LED for displaying the transport. The sensors 14, 22, 23, 45 and 55 constitute means for determining a condition in which a document is transported.

A specific operation of the embodiment will be described with reference to FIGS. 3A and 3B and 4A–4G.

Figure 4A:
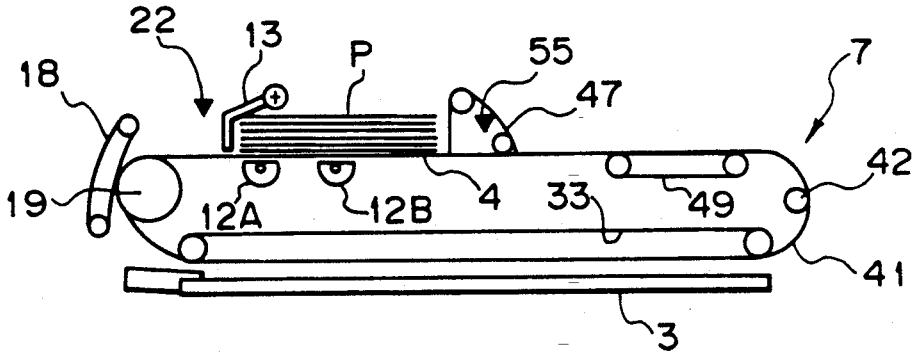
FIGS. 4A–4G are views showing a sequence of sheet feeding steps.
Figure 4B:
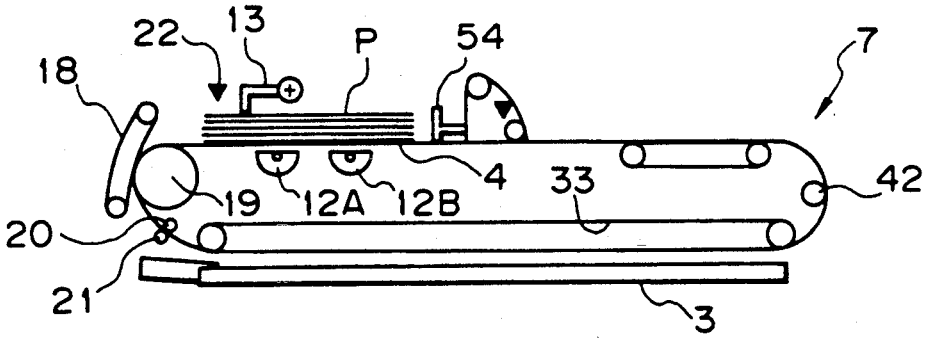

First, the operator puts a stack of documents P on the table 4 face up such that the leading edge of the stack P abuts against the gate pawl 13. Then, the operator moves the opposite side fences 11 toward each other to cause them to guide opposite sides of the stack P and, thereafter, moves the discharge unit 47 to a particular position matching the document size (FIG. 4A). As the operator presses a copy start key provided on the copier body 1, the CPU 100 determines whether or not the feed of documents should be started (step P31). If the answer of step P31 is positive, YES, the CPU 100 sends a signal to each of the solenoid 15 and thrust solenoid 95. As a result, the gate pawl 13 is raised away from the table 4, and the pick-up rollers 12A and 12B and thrust plate 54 are driven to drive the stack P toward the separator roller 19 (FIG. 4B). At this instant, the CPU 100 determines whether or not the division sensor 22 is in an OFF state (P32). If the answer of the step P32 is negative, NO, the CPU 100 determines that the gate pawl 13 is resting on the top of the stack P and advances to a step P35 for repeating the feed and discharge of documents.

Figure 4C:
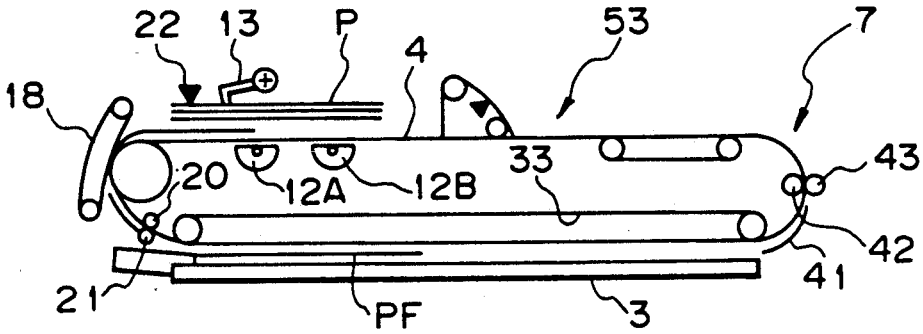
Figure 4D:
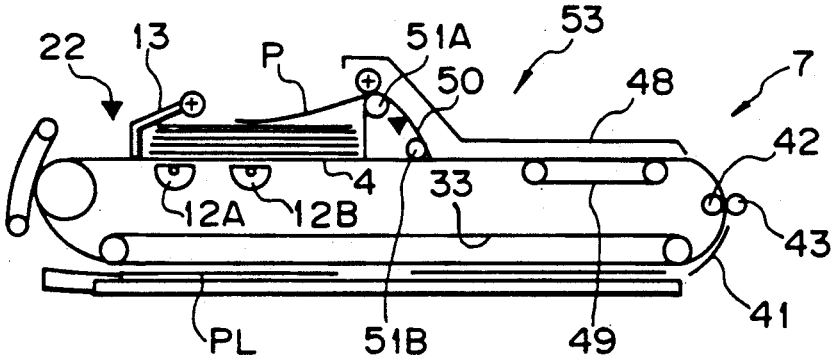

Specifically, as the documents in the lowermost portion of the stack P are driven to the separating section constituted by the belt 18 and separator roller 19, the lowermost document PF is separated from the overlying documents and transported to the pull-out rollers 20 and 21. The pull-out rollers 20 and 21 drive the document PF to the illuminating position on the glass platen 3 in cooperation with the belt 33 (FIG. 4C). After the copier body 1 has illuminated the document, the belt 33 transports the document to the turning means 7. The turn roller 42 and press roller 43 move the document along the turn guide 41 to thereby turn it over. In the returning subsection 53, the belt 49 transports the document having been turned over along the contractible guide 48, and then the discharge rollers 51A and 51B drive it out along the guide 50 onto the top of the stack P remaining on the table 4 (FIG. 4D). The documents sequentially returned to the top of the stack P in such a manner abut against the gate pawl 13 to be thereby divided from the documents remaining on the table 4 which have not been illuminated. At the same time, the skew of such documents is corrected by the gate pawl 13.

When the division sensor 22 is in an OFF state as determined in the step P32 (FIG. 4D), the CPU 100 determines that the last document PL (lying on the top of the documents which are oriented in the same direction) has been fed out, i.e., no documents exist below (forwardly of) the gate pawl 13. Then, the CPU 100 executes steps P33 and P34 for setting a feed flag and a last document memory.

Assume that the stack of documents P should be illuminated a plurality of times. In this case, a sequence of document feeding steps shown in FIG. 3B and a sequence of stack thrusting steps shown in FIG. 3C are executed.

Figure 3A:
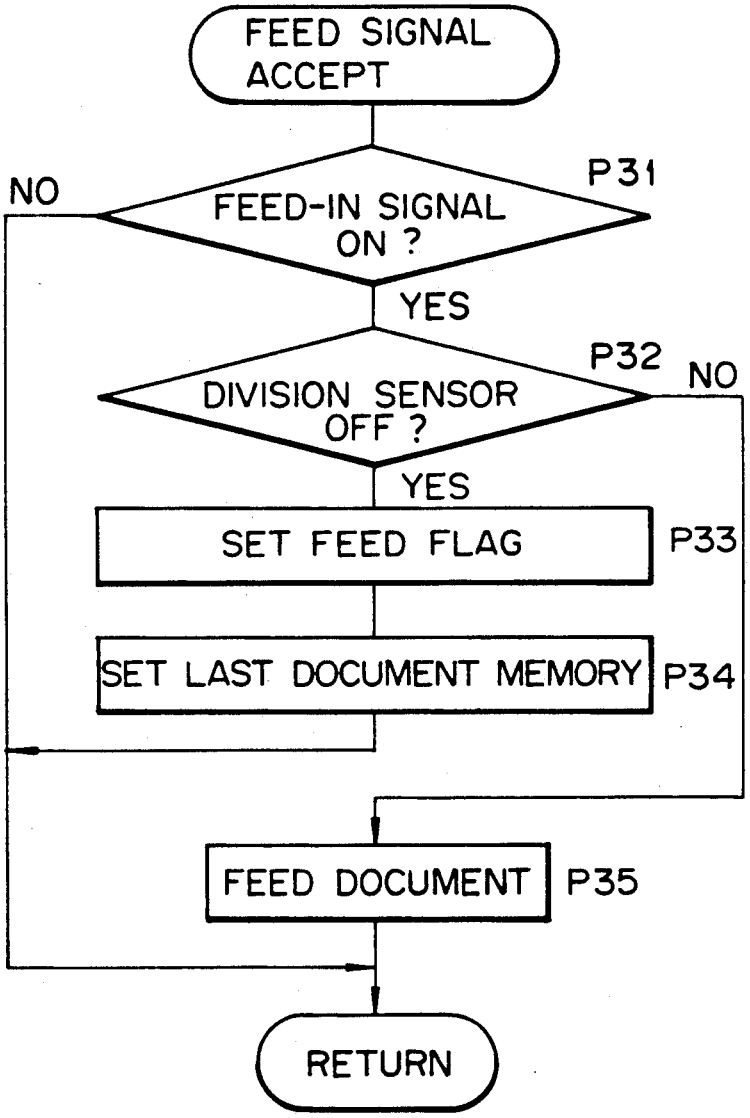
FIGS. 3A–3C are flowcharts demonstrating a specific operation of the embodiment.
Figure 3B:
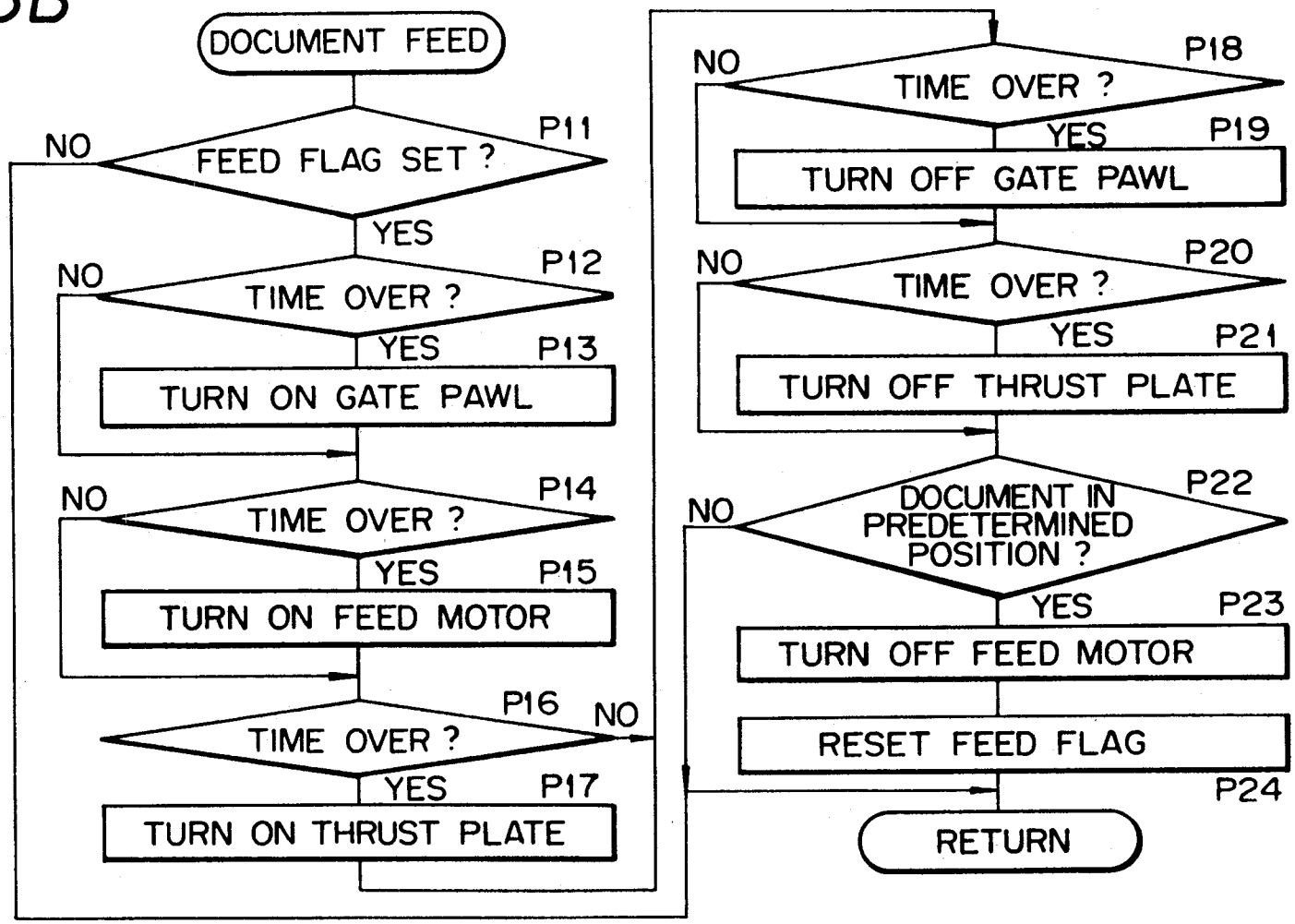
Figure 4E:
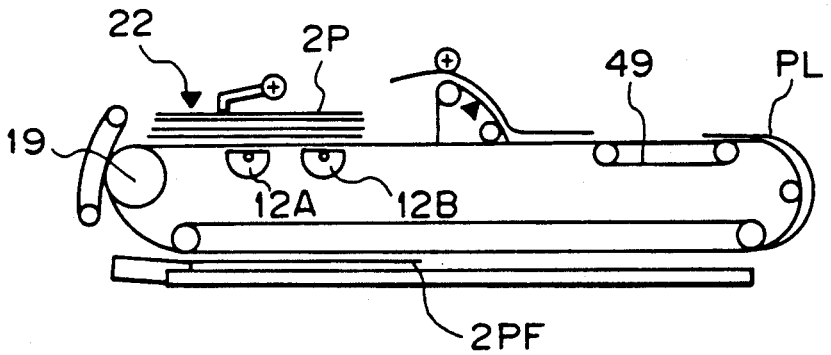
Figure 4F:
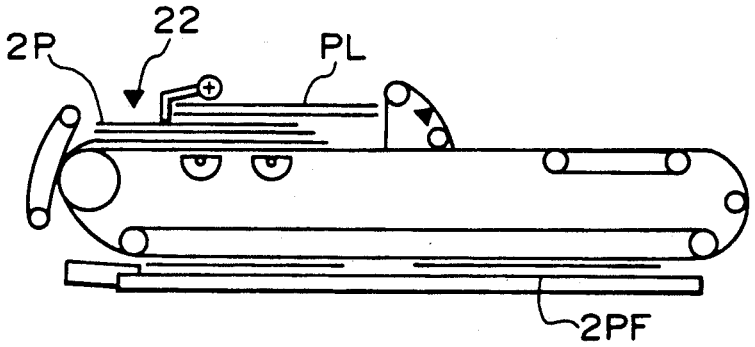

Specifically, as shown in FIG. 3B, the CPU 100 determines whether or not the feed flag is set (P11). If it is set, the controller 100 advances to a step P12 and, on the elapse of a predetermined period of time, executes a step P13 for feeding a signal to the solenoid 15. As a result, the gate pawl 13 is moved away from the table 4. Then, the CPU 100 determines whether or not a predetermined period of time has expired (P14) and then drives the feed motor 35 (P15), thereby driving the pick-up rollers 12A and 12B and separator roller 19. As a predetermined period of time expires (P16), the CPU 100 energizes the thrust solenoid 95 to cause the thrust plate 54 to push the trailing edge of the stack forward. The thrust plate 54 moves the second cycle of documents 2P toward the separator roller 19. As a result, the lowermost document is transported to the predetermined position on the glass platen (FIG. 4E). On the lapse of a predetermined period of time (P18), the CPU 100 stops sending the signal to the solenoid 15 (P19) with the result that the gate pawl 13 rests on the top of the stack 2P. At this instant, the gate 13 contacts a document which is not the last document PL of the first cycle of documents, thereby dividing the second cycle of stack 2P from the first cycle of stack PL. Subsequently, as a predetermined period of time elapses (P20), the CPU 100 deenergizes the thrust solenoid 92 (P21). As the CPU 100 determines that the document has been brought to the predetermined position on the glass platen 3 (P22), it deenergizes the feed motor 24 (P23) and then resets the feed flag (P24). The predetermined periods of time mentioned above are implemented with a timer responsive to a clock which is generated within the CPU 100. The timer is incremented by each 5 milliseconds every time the step of the feed flow increases. Specifically, the timer is reset when the feed flag is set (P11) and then sequentially incremented.

Figure 3C:
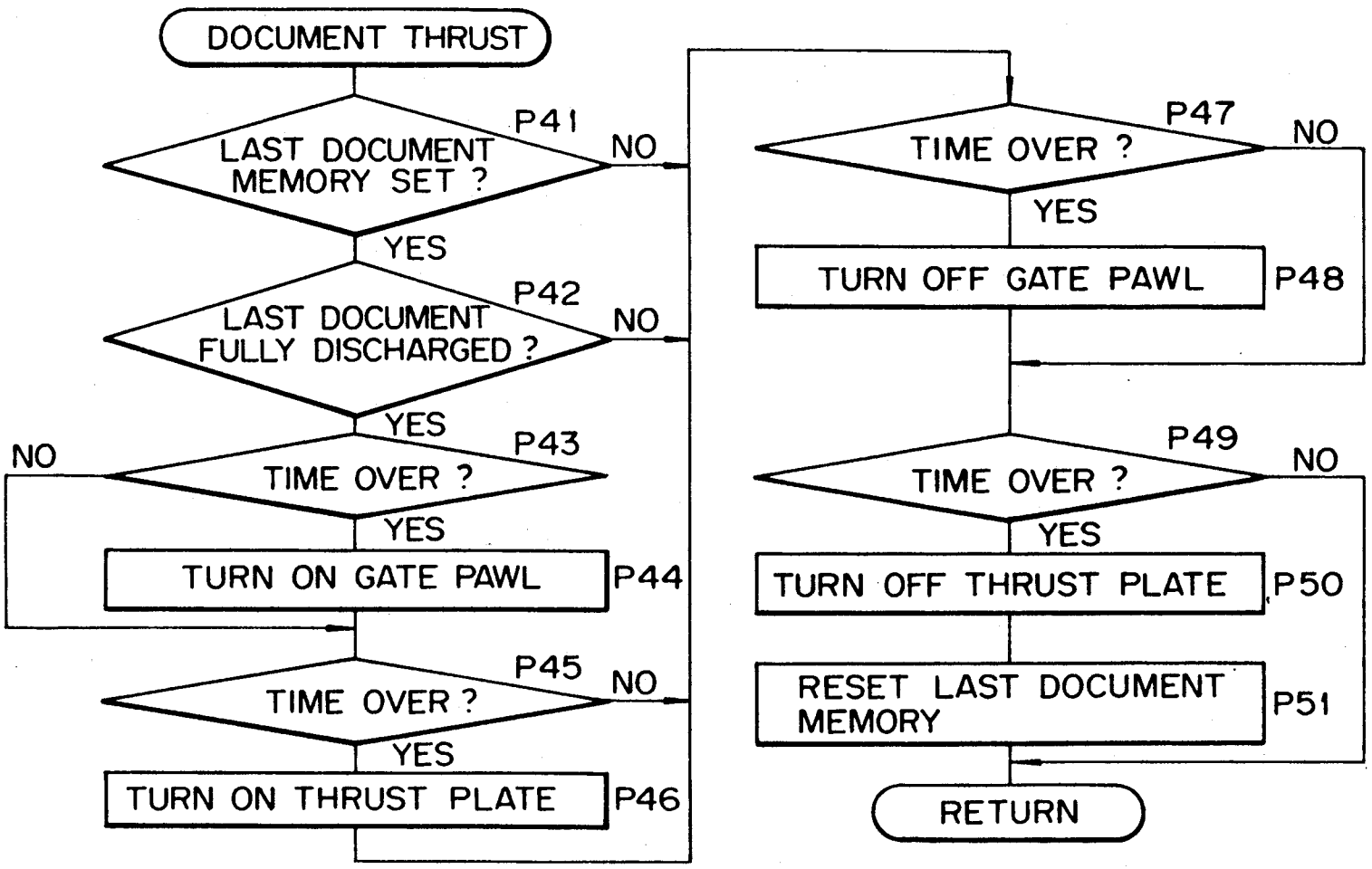
Figure 4G:
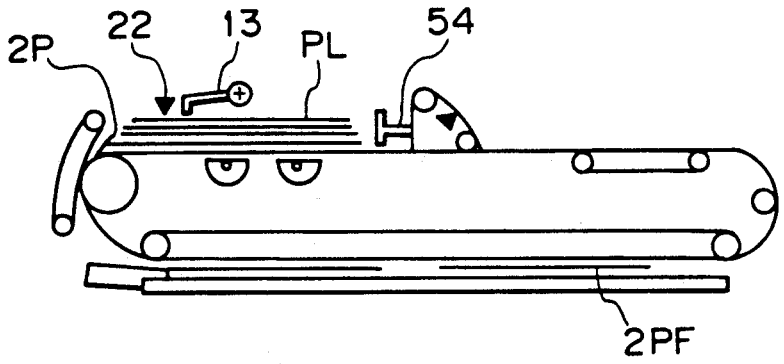

On the other hand, in the thrusting procedure shown in FIG. 3C, the CPU 100 determines whether or not the last document memory is set (S41). If the answer of the step S41 is YES, the CPU 100 checks the output of the discharge sensor 55 to see if the last document PL of the first cycle of documents has been driven out of the discharge unit 47 (P42). If the last document PL has been discharged (FIG. 4F), the document PL and the document discharged just before it abut against the gate pawl 13 to have their skew corrected. On the elapse of a predetermined period of time (P43), the CPU 100 energizes the solenoid 15 to raise the gate pawl 13 (P44). As a predetermined period of time elapses (P45), the CPU 100 energizes the thrust solenoid (P46) to cause the thrust plate 54 to push the trailing edge of the stack. As a result, the last document and the immediately preceding document are stacked on the second cycle of documents (FIG. 4G). Subsequently, on the elapse of a predetermined period of time (P47), the CPU 100 deenergizes the solenoid 15 (P48) to cause the gate pawl 13 to rest on the stack, i.e., the last document of the first cycle of documents (the last document of the second cycle at the same time), whereby the second cycle of documents which have not been illuminated are divided from the illuminated documents. On the elapse pf a predetermined period of time (P49), the CPU 100 deenergizes the thrust solenoid 95 (P50) and then resets the last document memory.

The procedure described above is repeated to illuminate the second and successive cycles of documents. The above-described periods of time are counted by a timer which is implemented by a clock generated within the CPU 100. Again, the timer is incremented by each 5 milliseconds every time the step of the thrust flow increases. Specifically, the timer is reset when the last document is discharged (P51) and then sequentially incremented.

In summary, when a stack of documents should be illuminated a plurality of times, the illustrative embodiment moves the gate pawl 13 away from the table 4 just after the last document of the first cycle of documents P has been illuminated and, at the same time, starts feeding the second cycle of documents 2P. Then, the gate pawl 13 is brought into contact with the stack of documents. When the last document PL of the first cycle is discharged from the returning section 8, the gate pawl 13 is raised away from the stack 2P to move the remaining documents to the feed position. As a result, the first cycle of documents P are divided from the second cycle of documents 2P. This is successful in reducing the time over which the first and second cycles of documents should be divided from each other and, therefore, the overall copying time. Further, since the gate pawl 13 is brought into contact with the document stack when the last document PL of the first cycle is returned to the top of the stack after the feed of the second cycle of documents 2P, the last document and the document returned just before it are free from skew without fail.

An alternative embodiment of the present invention will be described with reference to FIGS. 5A–5C and 6A–6I. Since this embodiment is generally similar to the previous embodiment, the following description will concentrate on arrangements particular thereto. Briefly, when a stack of documents should be illuminated a plurality of times, the alternative embodiment causes the CPU 100 to move the gate pawl 13 away from the table 4 while the last document of the first cycle is illuminated, thereby starting the feed of the second cycle of documents. After the lowermost document of the second cycle has been transported to a position adjacent to the illuminating position on the glass platen 3, the gate pawl 13 is brought into contact with the document stack. As soon as the last document of the first cycle is driven out from the returning section 8, the gate 13 is again raised away from the document stack to allow the remaining documents to be transported to the feed position one after another. In this manner, the gate pawl 13 divides the first and second cycles of documents from each other.

Figure 5A:
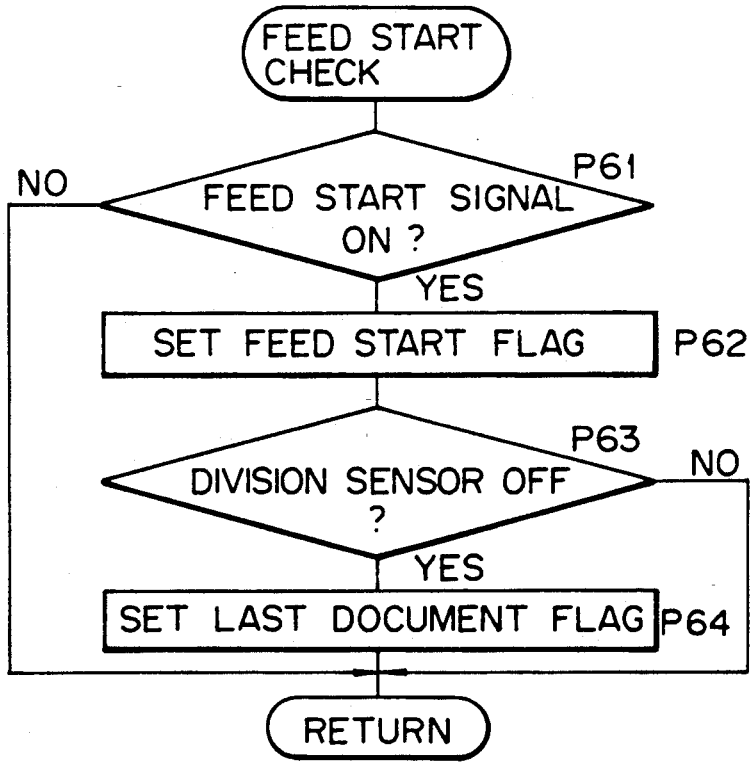
FIGS. 5A–5C are flowcharts representative of an alternative embodiment of the present invention.
Figure 6A:
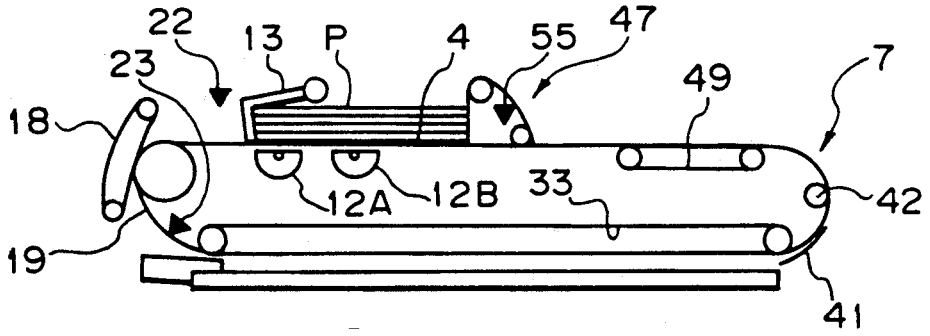
FIGS. 6A–6I are views showing a sequence of sheet feeding steps particular to the alternative embodiment.
Figure 6B:
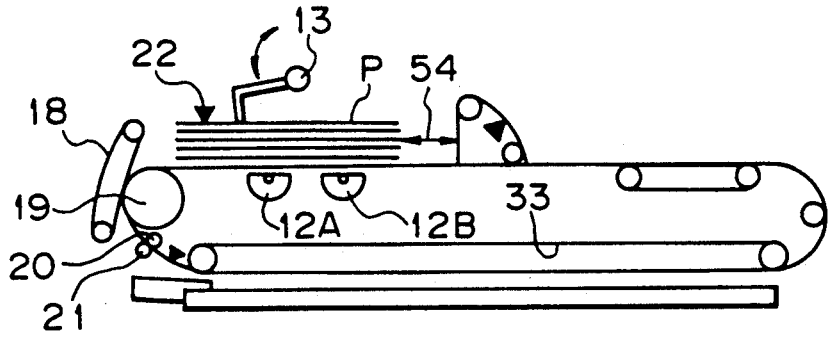
Figure 6C:
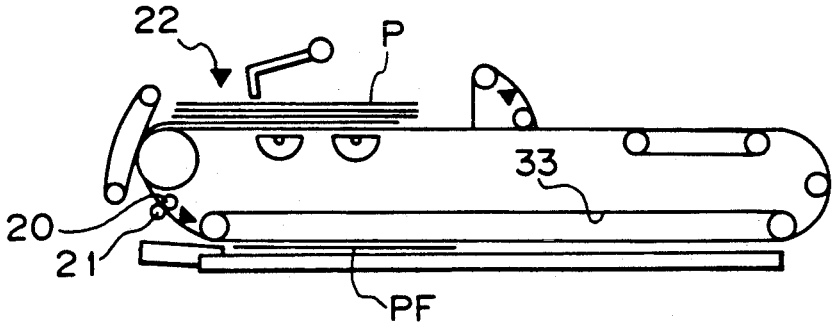
Figure 6D:
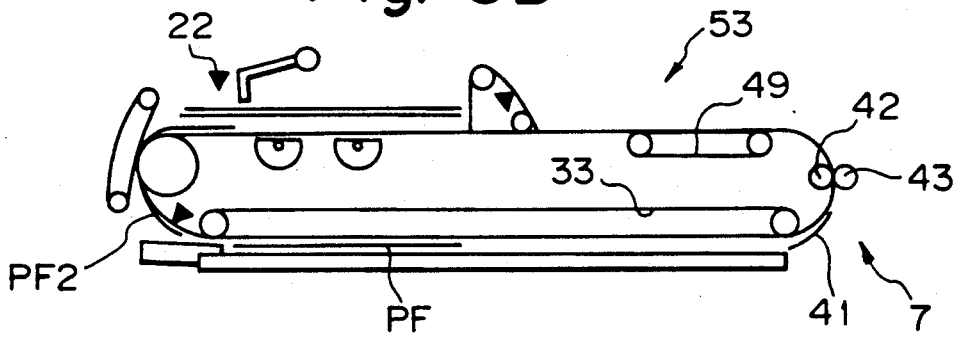
Figure 6E:
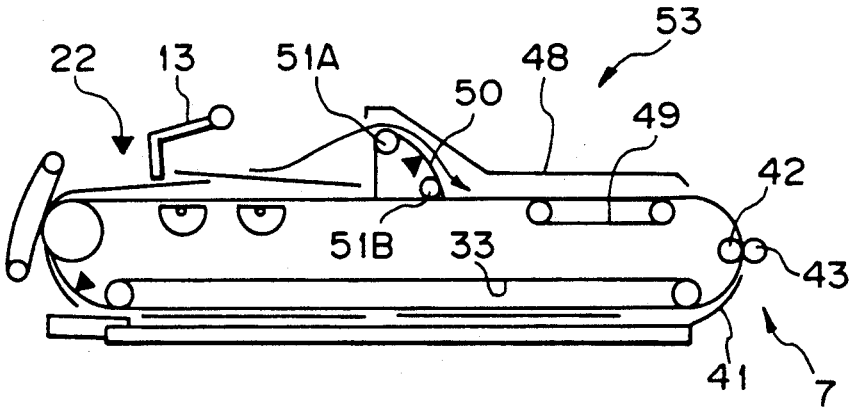
Figure 6F:
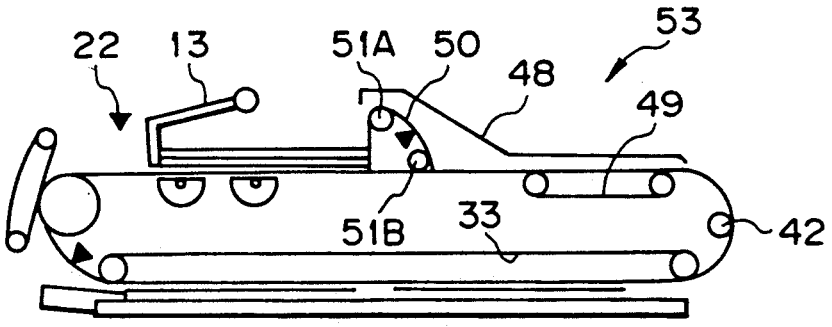

Specifically, the operator places a stack of documents P on the table 4 face up, moves the side fences 11 toward each other to cause them to guide opposite sides of the stack P, and then moves the discharge unit 47 to a particular position matching the document size (FIG. 6A). As the operator presses the copy start key provided on the copier body 1, the CPU 100 determines that a feed start signal has been inputted (P61, FIG. 5A). Then, after setting a feed start flag (P62), the CPU 100 raises the gate pawl 13 away from the table 4 and, at the same time, drives the pick-up rollers 12A and 12B and thrust plate 54 to move the stack P toward the separator roller 19 (FIG. 6B). After the lowermost document PF has been separated from the others by the separator roller 19, it is driven to the pull-out rollers 20 and 21. The pull-out rollers 20 and 21 move the document PF to the illuminating position on the glass platen 3 in cooperation with the belt 33. After the document PF has been positioned on the glass platen 3 (FIG. 6C), the second document PF2 is transported to the neighborhood of the illuminating position by the same procedure as the first document PF (FIG. 6D).

After the document has been illuminated by the copier body 1, the belt 33 transports it to the turning means 7. In the turning means 7, the turn roller 42 and press roller 43 turn over the document while moving it along the turn guide 41. The document having been turned over is conveyed along the contractible guide 48 by the intermediate belt 49 and then driven out along the guide 50 by the discharge rollers 51A and 51B. As a result, this document is returned to the top of the stack on the table 4. The documents sequentially returned to the top of the stack in the upside-down position each abuts against the gate pawl 13 to have the skew thereof corrected and is stacked on the document remaining on the table 4 while being divided from the latter by the gate pawl 13.

When the division sensor 22 is in an OFF state as determined in a step P63, FIG. 5A, the CPU 100 determines that the last document PL has been fed out and no documents exist below (forwardly of) the gate pawl 13. Then, the CPU 100 sets a last document flag (P64). When the stack of documents should be illuminated a plurality of times, the second cycle of documents are fed and thrusted while the last document PL is illuminated, as shown in FIGS. 5B and 5C.

Figure 5B:
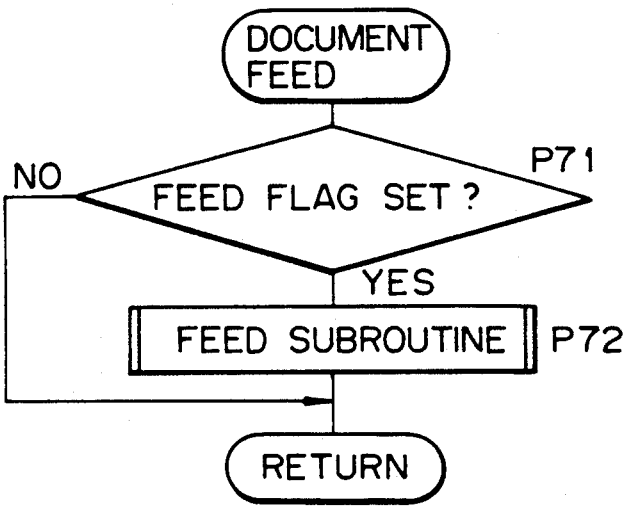
Figure 5C:
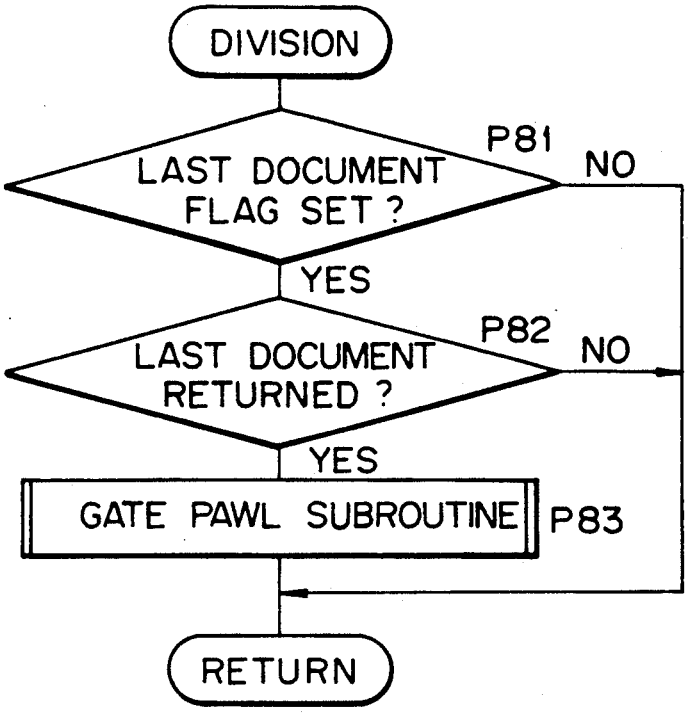
Figure 6G:
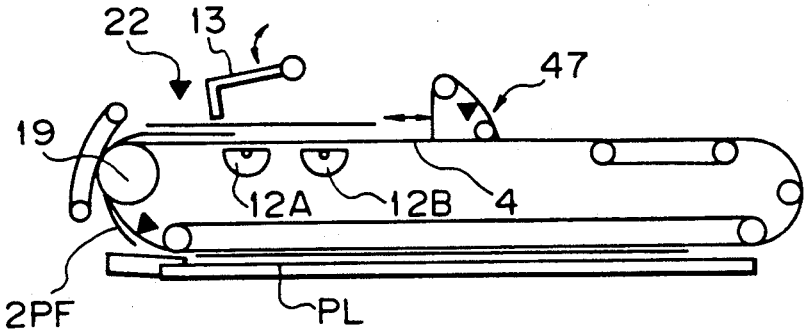
Figure 6H:
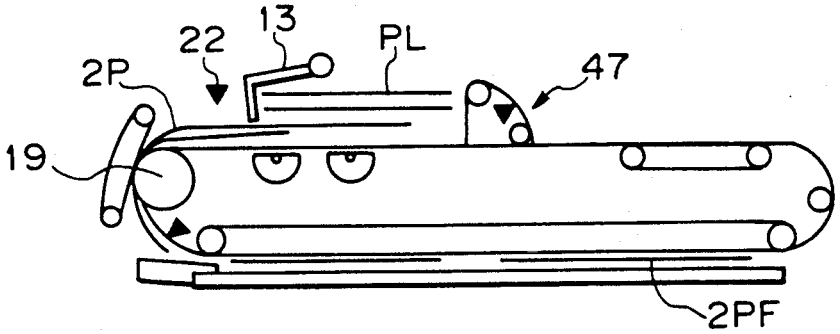
Figure 6I:
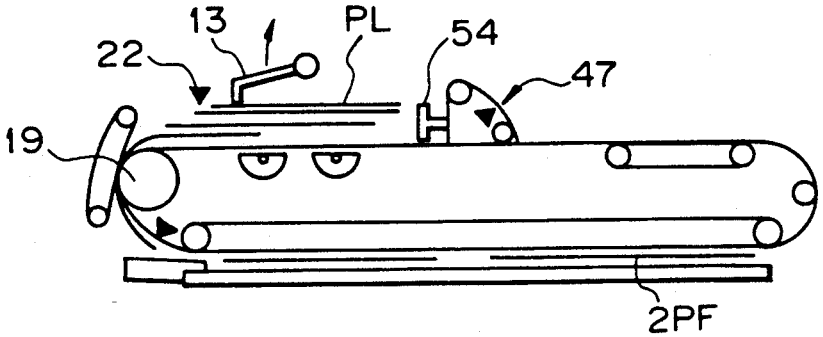

Specifically, if the feed flag is set as determined in a step P71, FIG. 5B, the CPU 100 executes a feed subroutine (P72). First, the CPU 100 moves the gate pawl 13 away from the table 4. In resonse to an illumination start signal from the copier body 1, the CPU 100 drives the pick-up rollers 12A and 12B, thrust plate 54 and separator roller 19 to thereby separate the lowermost document 2PF of the second cycle and feed it to the vicinity of the last document PL of the first cycle being illuminated (FIG. 6G). Subsequently, the CPU 100 brings the gate pawl 13 into contact with the top of the second cycle of documents 2P, i.e., a document which is not the last document PL of the first cycle. When a last document flag is set as determined in a step P81, FIG. 5C, the CPU 100 determines whether or not the last document has been returned to the top of the stack 2P by referencing the output of the discharge sensor 55 (P82). If the answer of the step P82 is YES, the CPU 100 determines that the last document PL of the first cycle has been illuminated and discharged to the top of the second cycle of documents 2P from the discharge unit 47 (FIG. 6H). Then, the CPU 100 executes a gate pawl subroutine (P83). Specifically, the CPU 100 moves the gate pawl 13 away from the document stack and causes the thrust plate 54 to push the document stack toward the separator roller 19 (FIG. 6I). Thereafter, the CPU 100 lowers the gate pawl 13 into contact with the document stack and then drives the feed motor 24 and other drive sources to start feeding the second cycle of documents. The procedure described above is repeated to illuminate the second and successive cycles of documents.

As stated above, when a stack of documents should be illuminated a plurality of times, this embodiment moves the gate pawl 13 away from the table 4 while the last document PL of the first cycle of stack P is illuminated, thereby starting feeding the second cycle of documents 2P. As soon as the lowermost document 2PF of the second cycle reachs a position adjacent to the illuminating position, the gate pawl 13 is lowered to contact the document stack 2P. When the last document PL of the first cycle is discharged from the returning section 8, the gate pawl 13 is moved away from the stack 2P to allow the remaining documents to be sequentially fed to the feed position. By such a procedure, the gate pawl 13 divides the first and second cycles of documents P and 2P from each other. This embodiment is comparable with the previous embodiment regarding the advantages attainable therewith.

A reference will be made to FIG. 7 for describing specific control heretofore executed with a RADF of the type shown in FIG. 1. The conventional control executes the feed of documents in the same manner as described with reference to FIG. 3.

Figure 7:
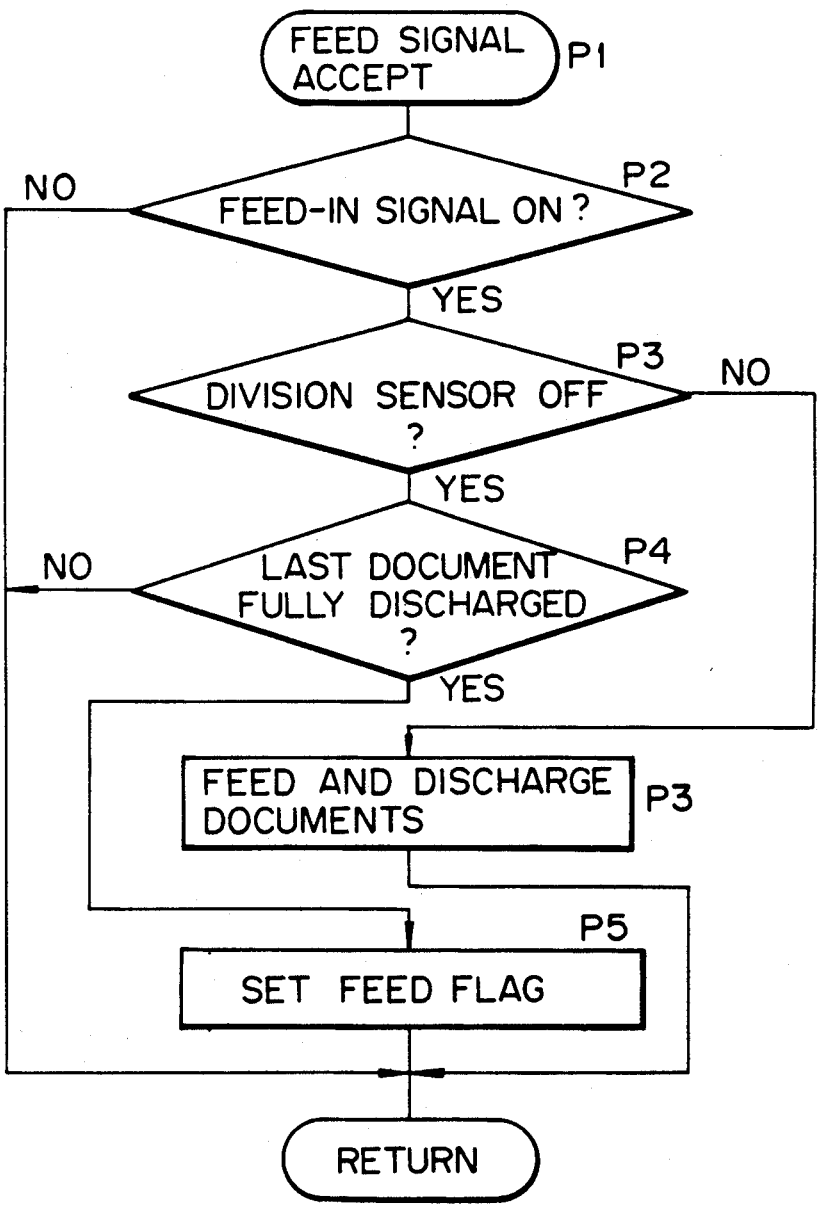
Fig. 7 PRIOR ART
FIG. 7 is a flowchart demonstrating a RADF program implemented by a conventional control system.

In FIG. 7, to accept a feed signal, whether or not a feed-in signal is in an ON state is determined (P1) and, if the answer is YES, whether or no the documents are divided is determined (P2). If the answer of the step P2 is NO, documents are sequentially fed and discharged. Specifically, the documents stacked on the table 4 are sequentially fed to the illuminating position one after another, the lowermost document being first. The document undergone illumination is driven out to the top of the stack via the transporting section 6 and turning section 7. The second and successive documents are each illuminated in the same manner and then laid on the immediately preceding document. At this instant, the gate pawl 13 rests on the top of the stack remaining on the table 4. The documents sequentially returned to the top of the stack on the table 4 abut against the gate pawl 13 to have their skew corrected and are divided from the documents which have not been illuminated by the gate pawl 13.

If the division sensor 22 is in an OFF state (P2), whether or not the last document has been discharged is determined (P4). If the last document of the first cycle has been discharged and laid on the top of the stack as determined in the step P4, a feed flag is set (P5). When the second cycle of documents are to be illuminated, whether or not the feed flag is set is determined (P11, FIG. 3B) and, if it is set, it is determined that the last document of the first cycle has been driven out from the discharging section. Then, as a predetermined period of time expires (P12), the gate pawl 13 is moved away from the table 4 (P13). On the lapse of a predetermined period of time (P14), the feed motor is driven (P15). As a predetermined period of time expires (P16), the thrust plate 54 is actuated to move the stack toward the feeding section 5. As a result, the documents are sequentially fed to the illuminating position. On the elapse of a predetermined period of time (P18), the gate pawl 13 is turned off (P19). When a predetermined period of time expires (P20), the thrust plate 54 is deactivated (P21). Subsequently, when it is determined that the document has reached the illuminating position (P22), the feed motor is deenergized (P23), and then the feed flag is reset (P24). The predermined periods of time mentioned above are implemented by a timer responsive to a clock which is generated within control means. The timer is incremented by each 5 milliseconds every time the step of the feed flow increases. When the feed flag is set as determined in the step P11, the timer is reset and then sequentially incremented.

The conventional control over a RADF described above has the following problem. When a stack of documents should be illuminated a plurality of times, the conventional control starts feeding the first document of the second cycle only after fully discharging the last document of the first cycle to the table. More specifically, it is only after the first cycle of documents have been entirely discharged that the second cycle of documents are fed. The conventional control, therefore, consumes a substantial period of time in replacing the first and successive cycles of documents. This is especially true with a RADF whose returning section extends over a substantial distance, resulting in an undesirably long exposing time, i.e., copying time.

In summary, when a stack of documents should be illuminated a plurality of times, the present invention moves a gate pawl away from a table just after the last document of the first cycle of documents has been illuminated, then brings the gate pawl into contact with the top of the stack, and then moves the gate pawl away from the stack when the last document of the first cycle is discharged from a returning section so as to feed the remaining documents to a feed position one by one. Causing the gate pawl to divide the first and second cycles of documents in such a manner is successful in reducing the time over which the first and second cycles of documents are divided from each other and, therefore, the overall copying time. After the second cycle of documents have been fed, the gate pawl is caused into contact with the stack when the last document of the first cycle is returned to the stack. Hence, the last document and the document returned just before it are free from skew without fail.

Further, in accordance with the present invention, before the last document of the first cycle is returned to the top of the stack on the table, the second cycle of documents are fed to thereby reduce the division time and, therefoe, the overall copying time.

Various modifications will become possible for those skilled in the art after receiving the teachings of the present disclosure without departing from the scope thereof.

What is claimed is:

1. A recycling automatic document feeder (RADF) comprising:

a table to be loaded with a stack of documents;

a gate pawl located forwardly of said table with respect to an intended direction of document feed and movable into and out of contact with said table;

a feeding section comprising feeding means for feeding, when said gate pawl is moved away from said table, a stack of documents placed on said table one by one, the lowermost document being first;

a transporting section comprising transporting means for transporting the document fed from said feeding section to a predetermined illuminating position and, after illumination, discharging said document;

a returning section comprising turning means for turning over the document transported by said transporting means, said returning section returning said document discharged via said turning means to the top of said stack of documents;

sensing means for sensing a condition in which the documents are fed; and control means for controlling said gate pawl, said feeding means, said transporting means and said turning means in response to output signals of said sensing means such that when said stack of documents is to be illuminated a plurality of times, said gate pawl is moved away from said table after the illumination of the last document of the first cycle of documents to start the feed of the second cycle of documents, then said gate pawl is brought into contact with the top of said stack, and then said gate pawl is moved away from the top of said stack to transport the remaining documents to a feed position one by one, whereby said gate pawl divides said first and second cycles of documents from each other.

2. A recycling automatic document feeder RADF as claimed in claim 1, further comprising thrusting means for thrusting said stack of documents on said table toward said feeding section.

3. A recycling automatic document feeder RADF as claimed in claim 2, wherein said control means comprises a central processing unit.

4. An recycling automatic document feeder RADF comprising:

a table to be loaded with a stack of documents;

a feeding section comprising a gate pawl movable into and out of contact with said table, and feeding means for feeding, when said gate pawl is moved away from said table, a stack of documents placed on said table one by one, the lowermost document being first;

a transporting section comprising transporting means for transporting the document fed from said feeding section to a predetermined illuminating position and, after illumination, discharging said document;

a returning section comprising turning means for turning over the document transported by said transporting means, said returning section returning said document discharged via said turning means to the top of said stack of documents;

sensing means for sensing a condition in which said documents are fed; and control means for controlling the operation of said gate pawl, said feeding means and said turning means in response to output signals of said sensing means such that when said stack of documents are to be illuminated a plurality of times, said gate pawl is moved away from said table during the illumination of the last document of the first cycle of documents to thereby start the feed of the second cycle of documents, then said gate pawl is brought into contact with the top of said stack after the lowermost document of said second cycle of documents has been transported to a position adjacent to said illuminating position, and then said gate pawl is moved away from said stack when the last document of the first cycle of documents is discharged from said returning section, whereby said gate pawl divides said first and second cycles of documents from each other.

5. A recycling automatic document feeder RADF as claimed in claim 4, further comprising thrusting means for thrusting said stack of documents on said table toward said feeding section.

6. A recycling automatic document feeder RADF as claimed in claim 5, wherein said control means comprises a central processing unit.

* * * * *